US006095769A

United States Patent [19]

McKay

[11] Patent Number: 6,095,769

[45] Date of Patent: Aug. 1, 2000

[54] TWO SECTION PUMP

[75] Inventor: Michael Leonard McKay, Kardinya, Australia

[73] Assignee: Orbital Engine co. (Australia) Pty Limited, Balcatta, Australia

[21] Appl. No.: 08/714,084

[22] PCT Filed: Mar. 29, 1995

[86] PCT No.: PCT/AU95/00178

§ 371 Date: Sep. 27, 1996

§ 102(e) Date: Sep. 27, 1996

[87] PCT Pub. No.: WO95/26462

PCT Pub. Date: Oct. 5, 1995

[30] Foreign Application Priority Data

Mar. 29, 1994 [AU] Australia ..... PM 4768

[51] Int. Cl.[7] ..... F04B 17/04

[52] U.S. Cl. ..... 417/417; 137/554; 92/13.51

[58] Field of Search ..... 417/417, 63; 137/553, 137/554; 92/13.6, 13.51

[56] References Cited

U.S. PATENT DOCUMENTS

| | | | |
|---|---|---|---|
| 2,481,320 | 9/1949 | Madorsky | 103/53 |
| 2,832,296 | 4/1958 | Saalfrank | 103/153 |
| 3,044,401 | 7/1962 | Sawyer | 103/2 |
| 3,592,565 | 7/1971 | Kofnik | 417/417 |
| 3,958,902 | 5/1976 | Toyoda et al. | 417/279 |
| 4,699,044 | 10/1987 | Riggs | 92/13.6 |
| 4,838,763 | 6/1989 | Kramer et al. | 417/63 |
| 4,838,771 | 6/1989 | Kikuchi | 417/417 |
| 5,032,058 | 7/1991 | Williams et al. | 417/63 |
| 5,154,107 | 10/1992 | Morin et al. | 92/13.3 |
| 5,244,002 | 9/1993 | Frederick | 137/1 |
| 5,275,539 | 1/1994 | Custer, Jr. et al. | 417/401 |
| 5,564,470 | 10/1996 | Denmark et al. | 137/554 |
| 5,904,126 | 5/1999 | McKay et al. | 123/196 |

FOREIGN PATENT DOCUMENTS

| | | |
|---|---|---|
| 0 202 714 | 5/1986 | European Pat. Off. . |
| 0 286 404 | 4/1987 | European Pat. Off. . |
| 1 057 388 | 5/1959 | Germany . |
| 29 46 577 | 11/1980 | Germany . |
| 537 522 | 7/1993 | Switzerland . |

*Primary Examiner*—Timothy S. Thorpe
*Assistant Examiner*—Ehud Gartenberg
*Attorney, Agent, or Firm*—Arent Fox Kintner Plotkin & Kahn

[57] ABSTRACT

A pump including a first enclosure (10) and a second enclosure (20), a pumping mechanism (3) and an electromotive means (11,23) operable to drive the pumping mechanism (3). The electromotive means (11,23) includes a solenoid assembly (11) having a solenoid coil (13), and an armature assembly (23), the solenoid coil (13) being sealed within the first enclosure (10). The pump mechanism (3) is supported within the second enclosure (20), the armature assembly (23) being in operational relationship with the pumping mechanism (3). A diagnostic sensor (19) is sealed within the first enclosure (10) for detecting flow through a flow path (22) in the second enclosure (20). A flow responsive member (28) is supported within the flow path (22), the diagnostic sensor (19) detecting displacement of the flow responsive member (28).

35 Claims, 8 Drawing Sheets

TWO SECTION PUMP

This invention relates to pumps for pumping fluids and in particular liquids. The invention will be described in relation to an oil pump for an internal combustion engine although it is to be appreciated that other applications are also envisaged.

It was proposed in the Applicant's Australian Patent Application No. 79820/87 to provide an oil pump for an internal combustion engine wherein the electrical components of the pump which control the actuation of the pump mechanism and the pump mechanism itself are disposed within a common pump body.

The disadvantage of such an arrangement is that the electrical components may be exposed to any vacuum induced by the operation of the pump mechanism. There is therefore a potential for oil, water or other foreign matter to be drawn in through any cracks or gaps within the pump body. This can lead to the malfunctioning and even damage of the electrical components due, for example, to the potential short circuiting of the components.

Furthermore, the manufacturer of such a prior art pump requires both the electrical and mechanical pump components to be assembled in the same manufacturing facility. As electrical components should preferably be manufactured within a relatively clean environment with minimal oil and solvents present, the above pump may need to be assembled in an environment which is less than ideal for the more sensitive electrical components thereof. This can result in greater rejection rates for the completed pumps and the increased possibility of reliability problems.

It is an object of the present invention to overcome at least one of the above problems.

With this in mind, there is provided in one aspect a pump including a first enclosure and a second enclosure, a pumping mechanism and an electromotive means operable to drive the pumping mechanism, the electromotive means including a solenoid assembly having a solenoid coil, and an armature assembly, the solenoid coil being sealed within the first enclosure, the pump mechanism being supported within the second enclosure, the armature assembly being in operational relationship with the pumping mechanism, wherein a diagnostic sensor is sealed within the first enclosure for detecting flow within a flow path of the second enclosure. The electrical components of the pump, including the solenoid coil and the diagnostic sensor are therefore sealed within the first enclosure of the pump such that protection is provided for these components.

A flow responsive member may be supported within the flow path, the flow responsive member being displaceable when there is flow through the flow path, the diagnostic sensor detecting displacement of said member. A flow control valve may control the flow through the flow path. The flow responsive member may be supported adjacent to a valve member of the flow control valve and movable therewith. It is also envisaged that the flow responsive member may be the valve member of the flow control valve or may be formed integrally with the valve member of the flow control valve. Displacement of the flow responsive member can be sensed by the diagnostic sensor. To this end, the flow responsive member can be formed of a magnetic material and the diagnostic sensor may be a "Hall Effect" sensor. The flow control valve conveniently controls the inlet flow to the pump. The flow responsive member may be shaped such that the clearance between the flow responsive member and the flow path varies in the direction of movement thereof to vary the pressure gradient thereacross as the flow responsive member is displaced.

The Hall Effect sensor conveniently senses any displacement of the flow responsive member above a particular selected threshold value. Any displacement of a magnitude less than this threshold value will not be sensed by the sensor or will be ignored. The Hall Effect sensor conveniently provides a signal to a control system when displacement of the flow responsive member above said threshold value is sensed, the control system conveniently controlling a period of energisation of the solenoid coil. The control system conveniently also controls the frequency of pump actuation dependent on the fluid demand of the pump. For example, the frequency of pump actuation may be dependent on the oil requirements of an engine.

The solenoid coil is conveniently hermetically sealed within the first enclosure. The diagnostic sensor may also be hermetically sealed within the first enclosure which ensures that the solenoid coil and sensor are protected from oil, water or other foreign matter.

In a preferred arrangement, the solenoid coil is supported on a support reel, and the first enclosure may be in the form of an overmould casing which is moulded around the solenoid coil and support reel to seal the solenoid coil therein. The support reel may include an elongate bore passing therethrough and the overmould casing may allow access into the elongate bore of the reel. A cap may also be secured to the casing to cover an open end of the elongate bore.

The Hall Effect sensor may be supported in an extended leg of the first enclosure. In a preferred arrangement, the overmould casing moulded around the solenoid coil is also moulded around a circuit board incorporating the diagnostic sensor to produce the extended leg of the first enclosure. The extended leg may be positioned against a side wall of the second enclosure when the pump is assembled. The flow path within the second enclosure may be positioned adjacent the extended leg. The Hall Effect sensor may therefore be positioned adjacent the flow path in the assembled pump.

In a preferred arrangement, the Hall Effect sensor may also be positioned proximal to the solenoid coil of the solenoid assembly to thereby allow sensing of the magnetic flux of the solenoid coil when energised. The magnetic flux sensed by the sensor may be a function of the magnitude of the coil current and/or the number of windings of the solenoid coil. The polar direction of the solenoid coil may be arranged relative to the magnetic polarity of the flow responsive member so that the magnetic flux of the solenoid coil is adapted to be additive with the magnetic flux of the flow responsive member. An enhanced diagnostic system is provided by the above arrangement.

The armature assembly preferably includes an elongate armature sleeve, an elongate armature slidably supported within the sleeve, and an armature biasing means provided between the armature and a closed end of the armature sleeve, the armature sleeve being at least substantially locatable within a bore of the solenoid assembly, wherein the armature is displaceable by energisation of the solenoid coil. Displacement of the armature may be transmitted directly to the pumping mechanism. The armature biasing means may for example be a biasing spring. The armature assembly may conveniently be provided on the second enclosure.

In a preferred arrangement, the armature sleeve may be supported on a pole piece, with an open end of the armature sleeve being conveniently secured to the pole piece. The pole piece may conveniently be in the form of a plate which may extend in a plane at least substantially normal to an elongate axis of the armature sleeve. The open end of the armature sleeve may be press-fitted onto a stud extending from the pole piece plate. The armature assembly is conveniently secured to the second enclosure via the pole piece. In the preferred arrangement, the pole piece is press fitted or at least located within a co-operating shallow cavity provided on an end of the second enclosure.

At least a substantial portion of the armature sleeve supporting the armature is conveniently positioned within the elongate bore of the solenoid assembly when the pump is assembled to enable actuation of the armature upon energisation of the solenoid coil. The pole piece preferably completes a magnetic circuit of the armature assembly which allows the armature supported within the armature sleeve to be displaced when the solenoid coil is energised.

Movement of the armature may be transmitted directly to the pumping mechanism due to the operational relationship therewith. This can be achieved according to the preferred arrangement by the pole piece having a clearance bore extending therethrough for slidably supporting the armature to enable at least a portion of the armature to extend from the armature sleeve therethrough. The clearance bore may extend through the pole piece stud and plate. A portion of the armature may be an armature extension slidably supported within and extendable completely through the clearance bore for directly engaging the pumping mechanism.

The pumping mechanism conveniently includes a carrier having at least one piston supported thereon. Each piston may be slidably supported within a respective piston bore in the second enclosure. A plurality of pistons may be provided in the preferred arrangement. The lateral dimensions of each of the pistons and their corresponding piston bore may then be varied to adapt each piston to a particular pumping volume and/or fluid. The pump may therefore be adapted to pump more than one fluid.

The armature is conveniently coupled to the carrier such that movement of the armature will be transmitted to the carrier and hence the pistons. To this end, a free end of the armature extension may abut an engagement surface of the carrier to transmit movement of the armature to the carrier.

A seal means may be provided at or adjacent a free end of the or each piston, the seal means providing a seal during a pumping stroke of the piston and allowing fluid flow thereacross during an opposing return stroke of the piston. To this end, the seal means may be provided by a circumferential cavity adjacent the piston free end, and a circumferentially extending seal member supported within the cavity. The seal member may be moveable within the cavity in a direction parallel to the elongate axis of the piston between an inner shoulder and an opposing outer lip of the cavity. During the pumping stroke of the piston, the seal member conveniently moves to and abuts the inner shoulder to seal the piston against the piston bore. During the return stroke of the piston, the seal member conveniently moves to and abuts the outer lip which is adapted to allow fluid to flow therethrough.

The carrier may include guide means to guide the movement of the carrier. The guide means may include a guide post extending from the carrier and being slidably supported within a guide bore within the second enclosure. The guide means may guide the carrier so that the direction of movement of the pistons may be at least substantially parallel to the direction of movement of the armature.

A plug is conveniently provided within the guide bore, a free end of the guide post abutting the plug when the pistons reach the end of their pumping strokes. Accordingly, the position of the plug within the guide bore may be arranged to set the pumping stroke of the pistons. Hence, the plug may be variable in position to allow adjustment of the piston stroke.

The pistons preferably move through their pumping stroke during energisation of the solenoid coil and move back in their return stroke when the solenoid coil is de-energised. The armature therefore conveniently moves away from the closed end of the armature sleeve when the solenoid coil is energised as a result of the magnetic flux path coupling the armature, pole piece and solenoid coil. This movement may be transmitted to the carrier to move the pistons through their pumping stroke. The carrier may be supported on a biasing means which may provide a counter-acting force against the movement of the carrier induced by the armature. The biasing means may be in the form of a return spring extending between the guide post and the plug and may be supported in a cavity within the guide post and/or the plug. When the solenoid coil is de-energised, the carrier together with the armature are conveniently pushed back to their initial position by the return spring hence drawing the pistons back in their return stroke. The armature biasing means conveniently prevents the armature from impacting against the closed end of the armature sleeve while at the same time helping to maintain contact between the free end of the armature extension with the engagement surface on the carrier. This further prevents any impact noise during the return stroke of the pistons.

According to another aspect of the present invention, there is provided a pump including a first enclosure and a second enclosure, a pumping mechanism and an electromotive means operable to drive the pumping mechanism, the electromotive means including a solenoid assembly having a solenoid coil, and an armature assembly, the solenoid coil being sealed within the first enclosure, the pump mechanism being supported within the second enclosure, the armature assembly being in operational relationship with the pumping mechanism, wherein the armature assembly includes an elongate portion supportable within a central bore of the solenoid assembly. The armature assembly may be supported by the second enclosure.

The present invention also provides a method for setting the piston stroke of a pump as described above including the steps of locating a production jig in the corresponding shallow cavity of the second enclosure, the production jig including a datum surface and a stepped portion extending from the datum surface and providing a calibration surface, the datum surface abutting the bottom surface of the cavity with the stepped portion extending into the second enclosure and abutting the carrier, and press fitting the plug into the guide bore until the plug abuts the carrier guide post, wherein the spacing between the datum surface and the calibration surface is at least substantially identical to the piston stroke to be set. The datum surface of the production jig is positioned in a plane corresponding to a plane of an inner surface of the pole piece when fitted in the shallow cavity. This method provides a rapid and accurate way of setting the piston stroke.

The pump arrangement provides the opportunity for all of the electrical/electronic components which require an electric current thereto for correct operation to be supported within the first enclosure of the pump. These components are therefore isolated from the pumping mechanism supported within the second enclosure of the pump. The advantage of this arrangement is that the electrical/electronic components are not subjected to any vacuum induced by the pumping mechanism. This minimises the possibility of leaks into the first enclosure supporting those electrical/electronic components.

Furthermore, the pump can be manufactured in two separate sections. As well as making it easier to outsource the manufacturer of each section of the pump, optimum conditions can be provided for the manufacturer of the section incorporating the electrical/electronic components and the section incorporating the pumping mechanism respectively. The two sections can then be assembled together in a simple operation.

The invention will be more readily understood from the following description of a preferred practical arrangement of the pump as illustrated in the accompanying drawings.

Figure 7A:
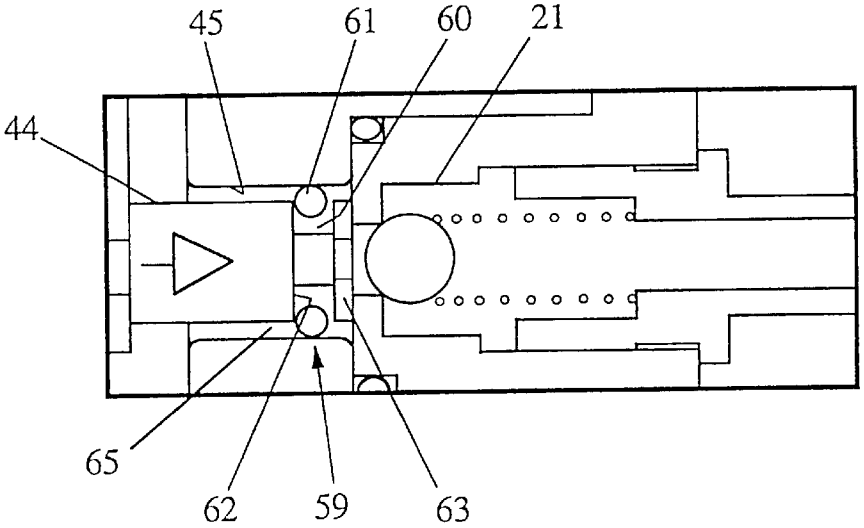
Figure 7B:
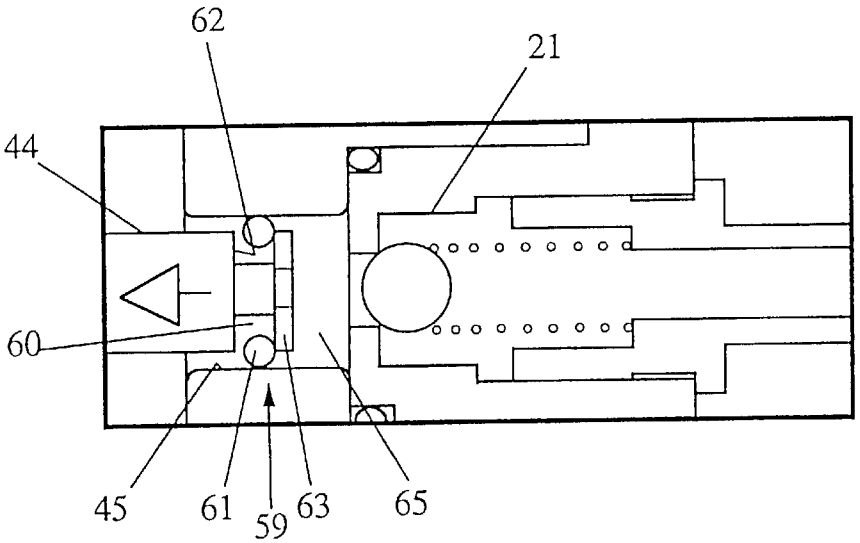
Figure 8:
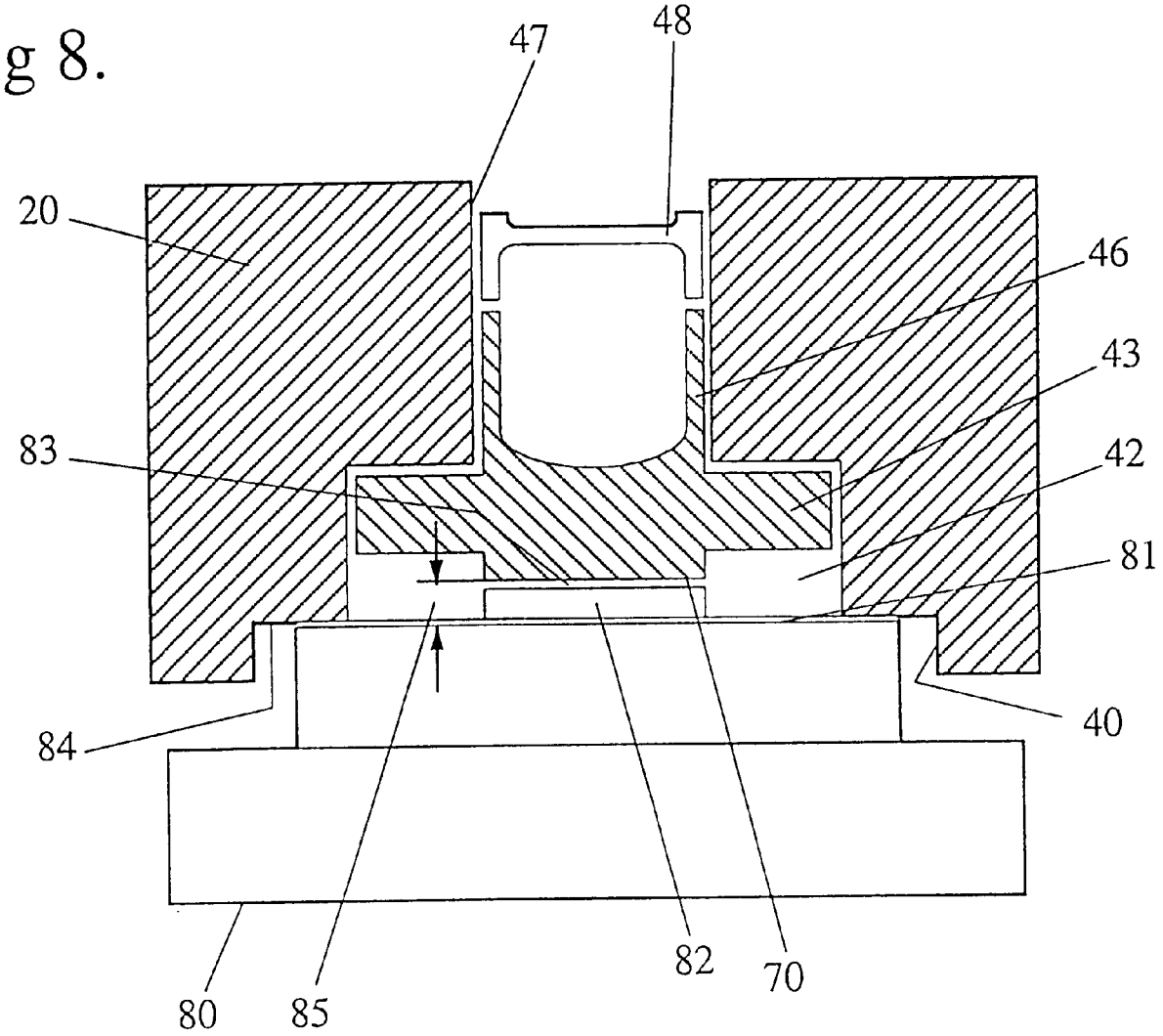

FIGS. 7*a* and 7*b* are schematic cross sectional views showing the operation of the piston at pumping and return strokes respectively; and FIG. 8 is a schematic longitudinal cross-sectional view of the second section showing a production method for setting the piston stroke.

Figure 1:
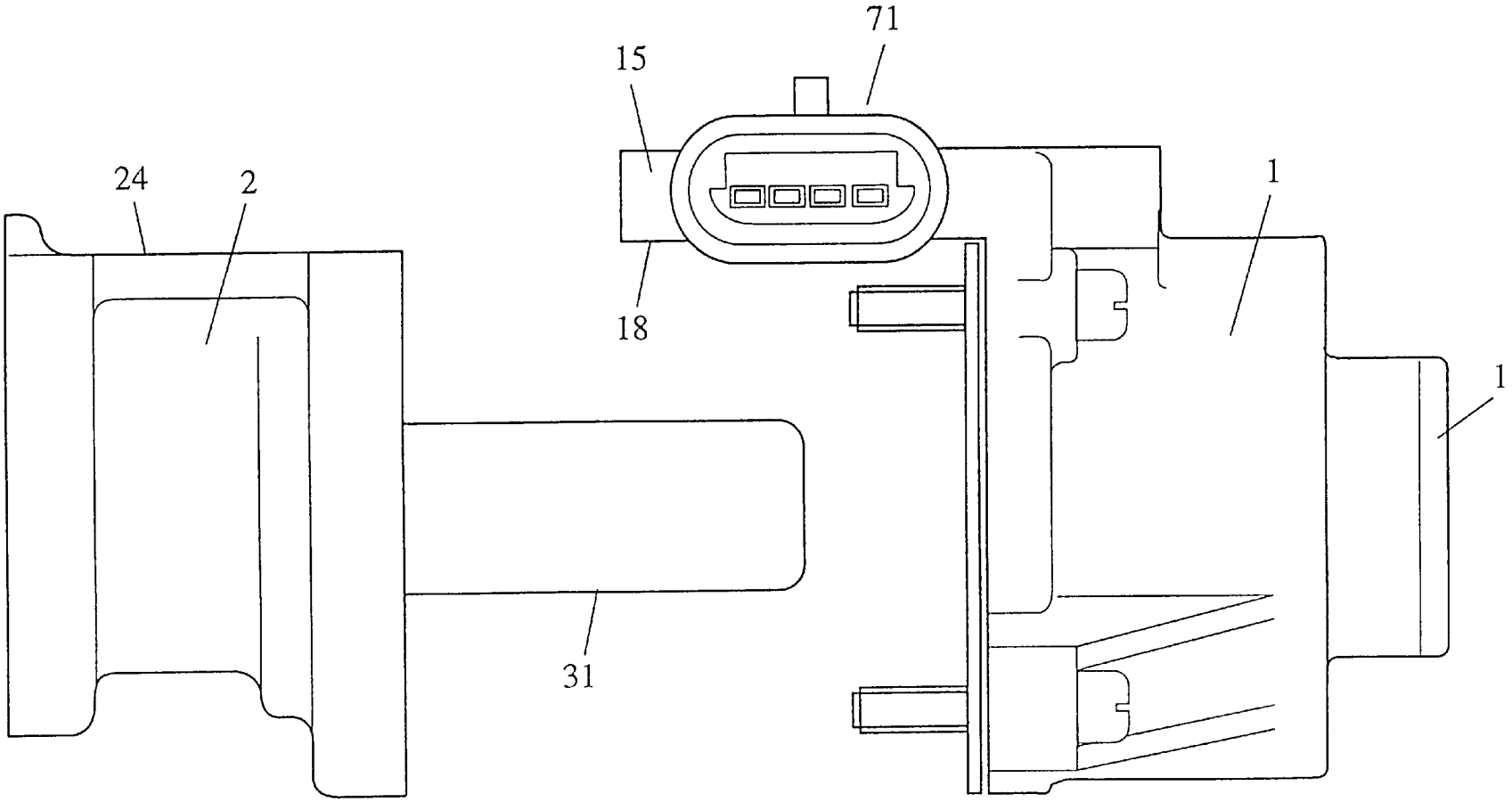
FIG. 1 is a side view of a pump according to the present invention separated into two sections.

Referring initially to FIG. 1, the pump has two main sections 1, 2, the first section 1 supporting the electrical and electronic components and the second section 2 supporting a pumping mechanism 3 shown in detail in FIGS. 3, 4, 5, 6, 7*a* and 7*b*.

Figure 2:
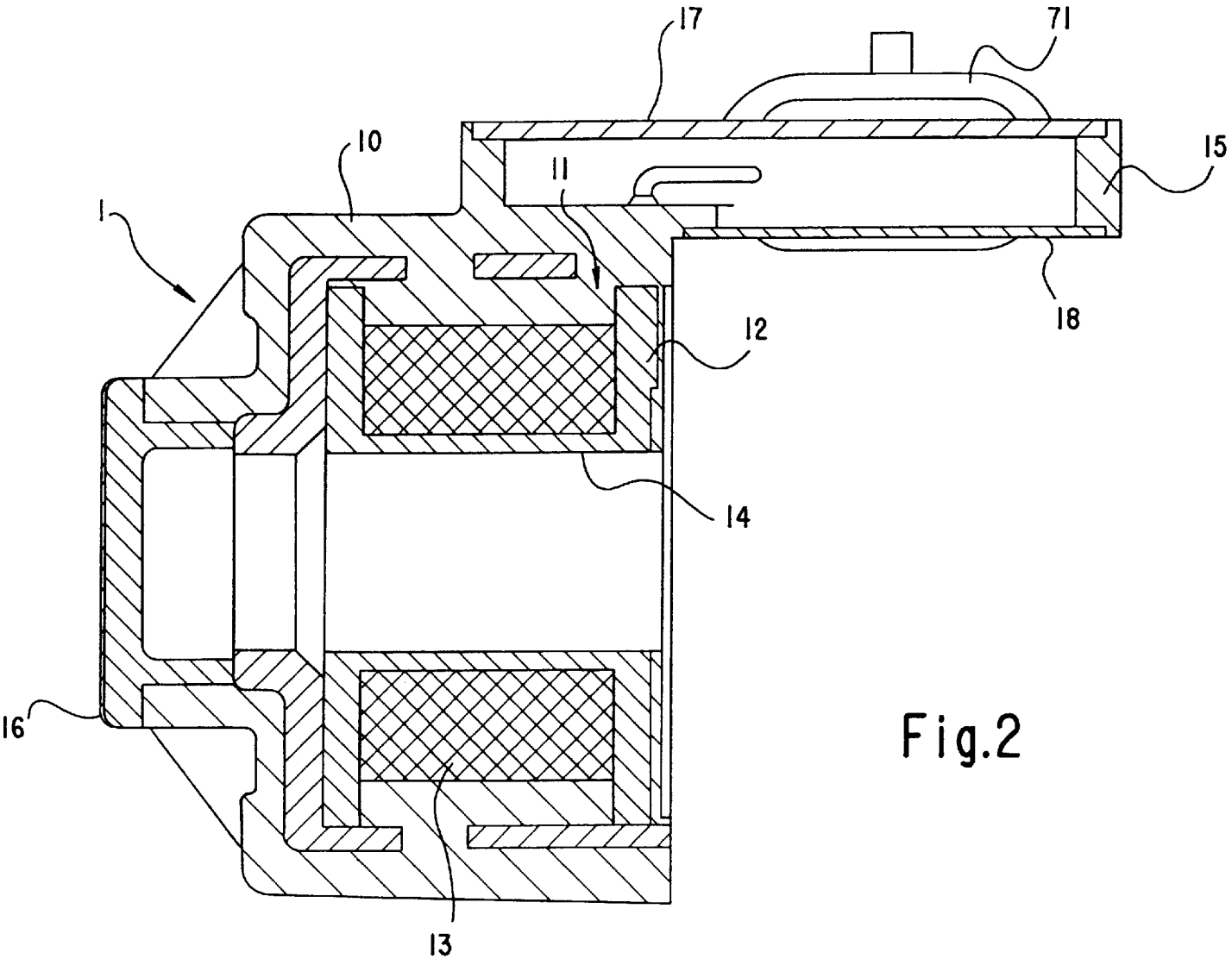
FIG. 2 is a longitudinal cross sectional view of a first section of the pump.

As shown in FIG. 2, the first section 1 has a first enclosure 10 supporting a solenoid assembly 11 therein. The solenoid assembly 11 includes a support reel 12 with a solenoid coil 13 wound thereon. An elongated bore 14 is provided through the reel 12. The first enclosure 10 also includes an extended leg 15 within which is supported a circuit board (not shown) providing a Hall Effect sensor 19 (see FIG. 6). A plug socket 71 is provided on the extended leg 15 to facilitate connection to a power source and control system using a conventional connector.

Both the coil 13 of the solenoid assembly 11 and the circuit board are encased by an overmould casing which is moulded around the solenoid assembly 11 and the circuit board during manufacture to thereby provide the first enclosure 10. This ensures that at least the solenoid coil 13 is hermetically sealed therein. A cap 16 is secured over an open end of the elongated bore 14. The circuit board may be supported on a support plate 17 which is secured to or moulded within the extended leg 15. A cover plate 18 is provided over the circuit board to protect and seal the circuit board within the extended leg 15.

Figure 3:
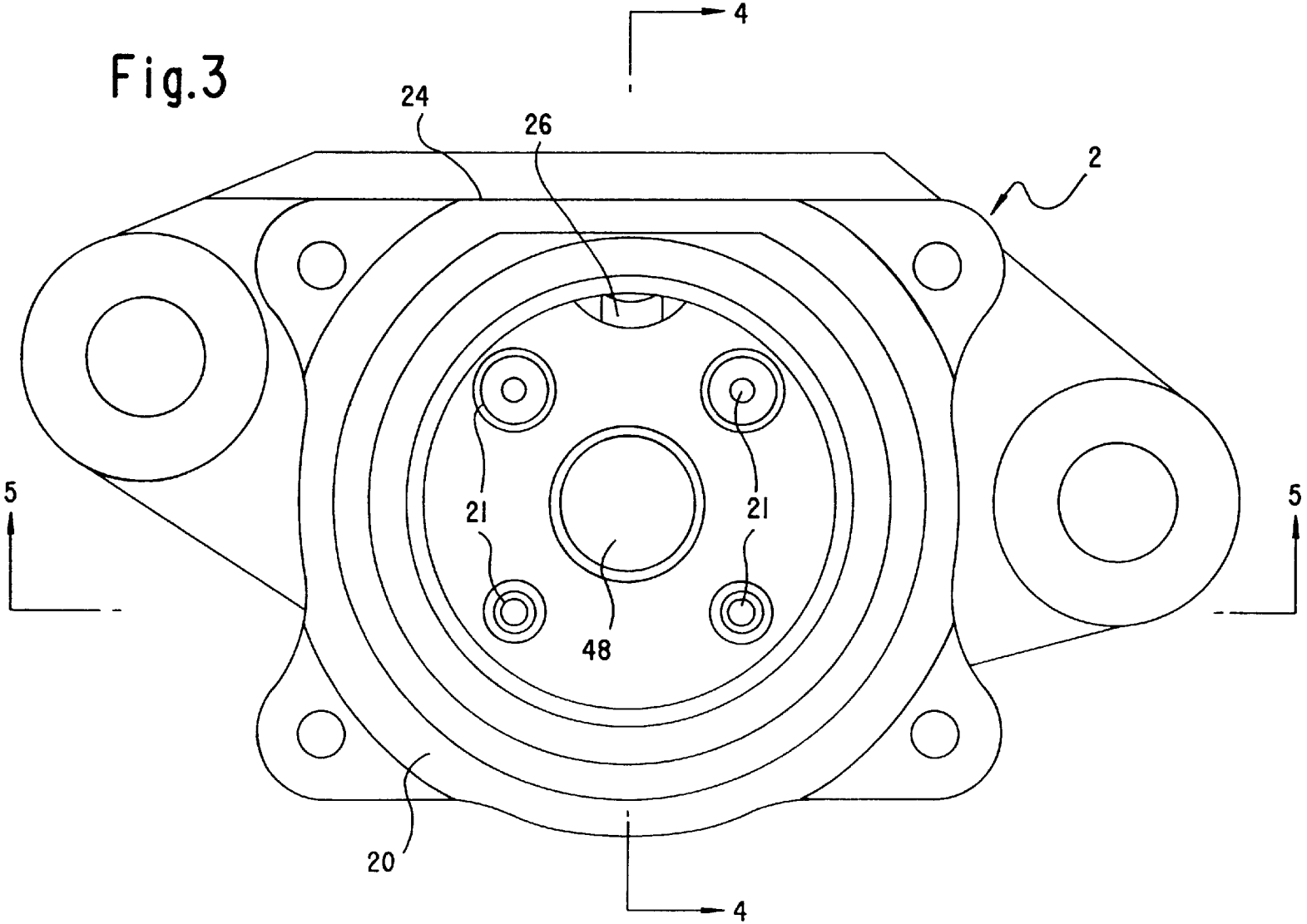
FIG. 3 is an end view of a second section of the pump.
Figure 4:
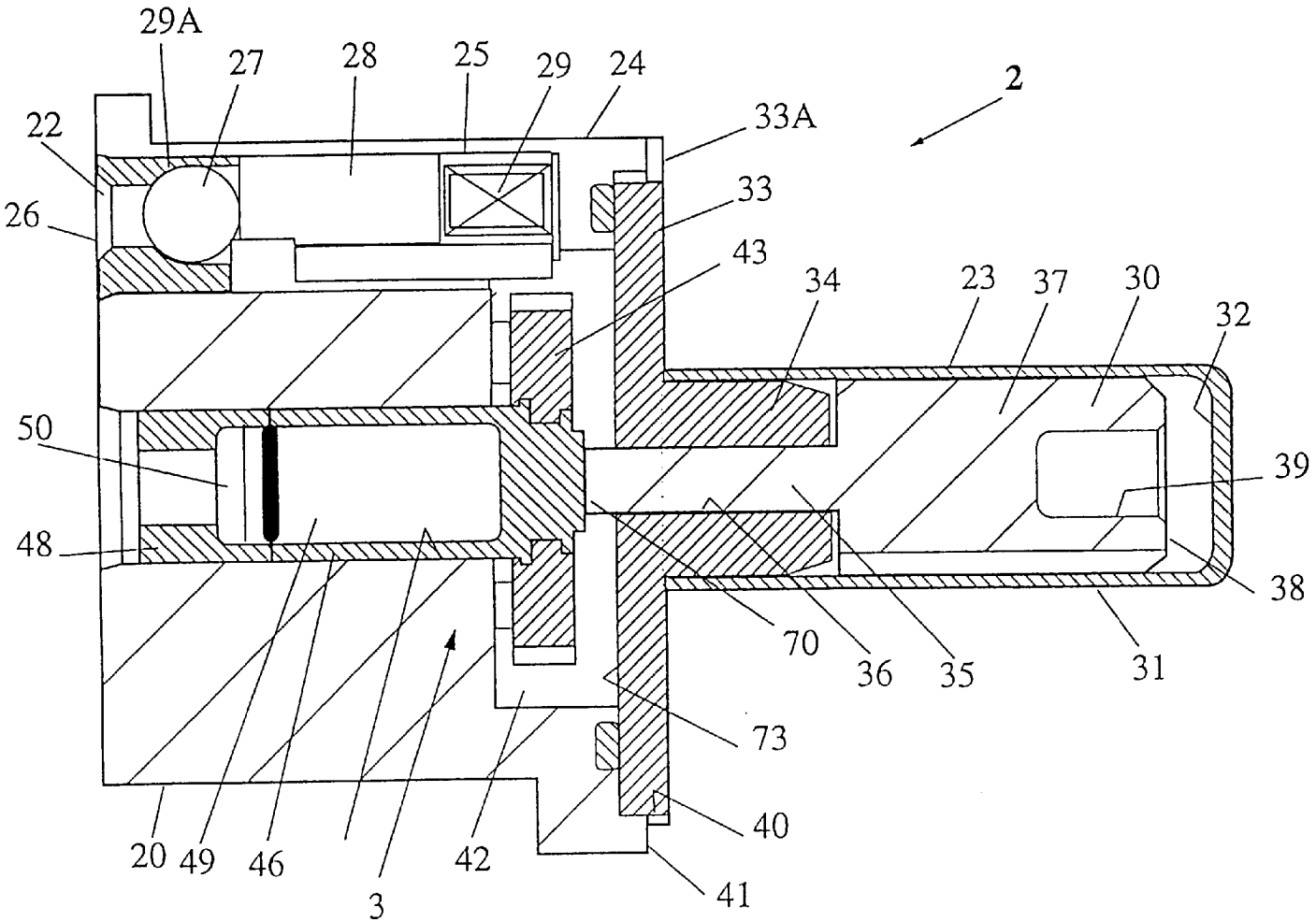
FIG. 4 is a longitudinal cross sectional view taken along line AA of FIG. 3.
Figure 5:
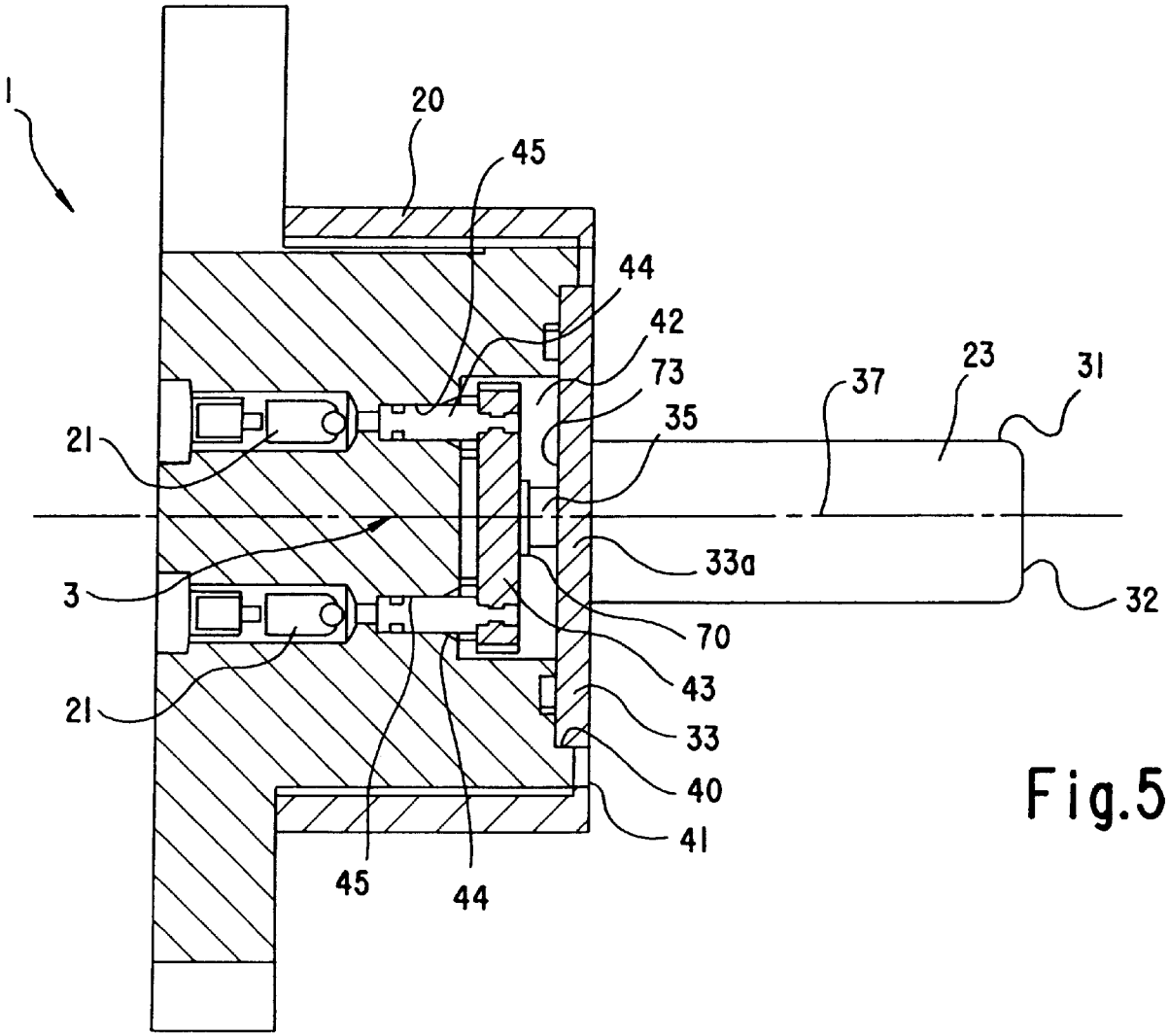
FIG. 5 is a longitudinal cross sectional view taken along line BB of FIG. 3.

As shown in FIGS. 3 to 5, the second section 2 includes a second enclosure 20 supporting the pumping mechanism 3, discharge check valves 21, an inlet relief valve 22 and an armature assembly 23. Referring to FIGS. 3 and 4, inlet relief valve 22 is provided within the second enclosure 20 for controlling fluid flow into the pump. If desired, a filter means may be arranged at or adjacent the inlet valve 22 in the known manner. The inlet relief valve 22 is positioned adjacent to and at least substantially aligned with a planar side surface 24 of the second enclosure 20 and includes an elongate valve cavity 25 and an inlet opening 26 through which the fluid to be pumped enters. Supported within the valve cavity 25 is a valve member 27, an elongate body element 28 and a valve spring 29. FIG. 4 shows the relief valve 22 in its closed position with the ball member 27 pressed against a valve seat 29*a* by the valve spring 29. The body element 28 is positioned between the valve member and the valve spring 29 and moves together with the valve member 27. The body element 28 is made of a magnetic material.

The body element 28 is displaceable within the valve cavity 25 when there is fluid flow through the inlet relief valve 22. This displacement is as a result of the fluid pressure gradient developed across the valve member 27 abutting the body element 28 resulting in a force being applied on the body element 28 by the valve member 27. The valve member 27 and body element 28 are returned to their initial position when the fluid flow is interrupted by the valve spring 29 and the fluid backflow. Although the valve member 27 is shown as having a "ball" shape in the drawings, other shapes are also envisaged. Also, the valve member may be integral with the body element.

The fluid flow is constrained by the clearance between the periphery of the valve member 27 and the body element 28 and the valve cavity 25. To this end, the pressure gradient across the valve member 27 and/or body element 28 can be varied as they are displaced in the valve cavity 25 by tapering or otherwise modifying the shape of the valve member 27 and/or the body element 28. This enables the displacement of the body element 5 relative to the fluid flow to be varied.

The armature assembly 23 includes an armature 30 slidably supported within an elongate armature sleeve 31 having a closed end 32. The end of the armature sleeve 31 opposing the closed end 32 is supported on a pole piece 33. The pole piece 33 may be in the form of a plate 33*a* having a stud 34 extending therefrom with an open end of the armature sleeve 31 being press-fitted over the stud 34. The armature 30 has an armature extension 35 projecting from one end thereof, the armature extension 35 being slidably supported and extending completely through a clearance bore 36 of the pole piece 33. This clearance bore 36 extends through the pole piece plate 33*a* and stud 34 and is at least substantially aligned with the elongate axis 37 of the armature sleeve 31. This allows the armature extension 35 to freely extend and retract through the clearance bore 36.

An armature biasing spring (not shown) is supported between the sleeve closed end 32 and an opposing end 38 of the armature 30. A holding bore 39 is provided at the armature end 38 to hold an end portion of the biasing spring.

The pole piece 33 is press fitted into a shallow cavity 40 provided in an end surface 41 of the second enclosure 20 thereby supporting the armature assembly 23 on the second enclosure 20. Separate securing means for connecting the pole piece 33 to the second enclosure 20 are also envisaged. Alternatively, the pole piece 33 can be integrally formed with the second enclosure 20. The pole piece 33 covers and seals a cavity 42 within the second enclosure 20 with the armature extension 35 being extendable into that cavity 42.

The pumping mechanism 3 is supported within the second enclosure 20 as best shown in FIG. 5. The pumping mechanism 3 includes a carrier 43 supported within the second enclosure cavity 42. A free end of the armature extension 35 abuts an engagement surface 70 on a side of the carrier 43 to transmit movement of the armature 30 to the carrier 43. It is also envisaged that the armature 30 may be formed integrally with or otherwise secured to the carrier 43. A plurality of pistons 44 are secured to and extend from the carrier 43 on an opposing side to the engagement surface 70. Each piston 44 is supported in a respective piston bore 45 and move in a direction at least substantially parallel to the direction of movement of the armature 30 although it is to be appreciated that this is not essential to the present invention. The piston bores 45 are in communication with cavity 42 which in turn is in communication with the valve cavity 25. The pistons 44 and the supporting piston bores 45 both have cylindrical cross sections although other cross sections are also envisaged. The pumping capacity of each piston 44 can be set differently by having a larger lateral cross section of the piston 44 and supporting bore 45 where a greater pumping capacity is required. This may also be used to facilitate the simultaneous pumping of more than one fluid by the pump. In such an arrangement separate inlet arrangements communicating with each piston bore 45 are envisaged.

As best shown in FIG. 4, the carrier 43 also includes a supporting guide post 46 which is slidably supported in a guide bore 47 extending through the second enclosure 20. The elongate axis of the guide bore 47 is at least substantially parallel to the piston bores 45 and is also at least substantially aligned with the direction of movement of the armature 30, although it is to be appreciated that this is not essential to the present invention. The guide post 46 therefore supports and guides the pistons 44 through their pumping and return strokes.

Figure 6:
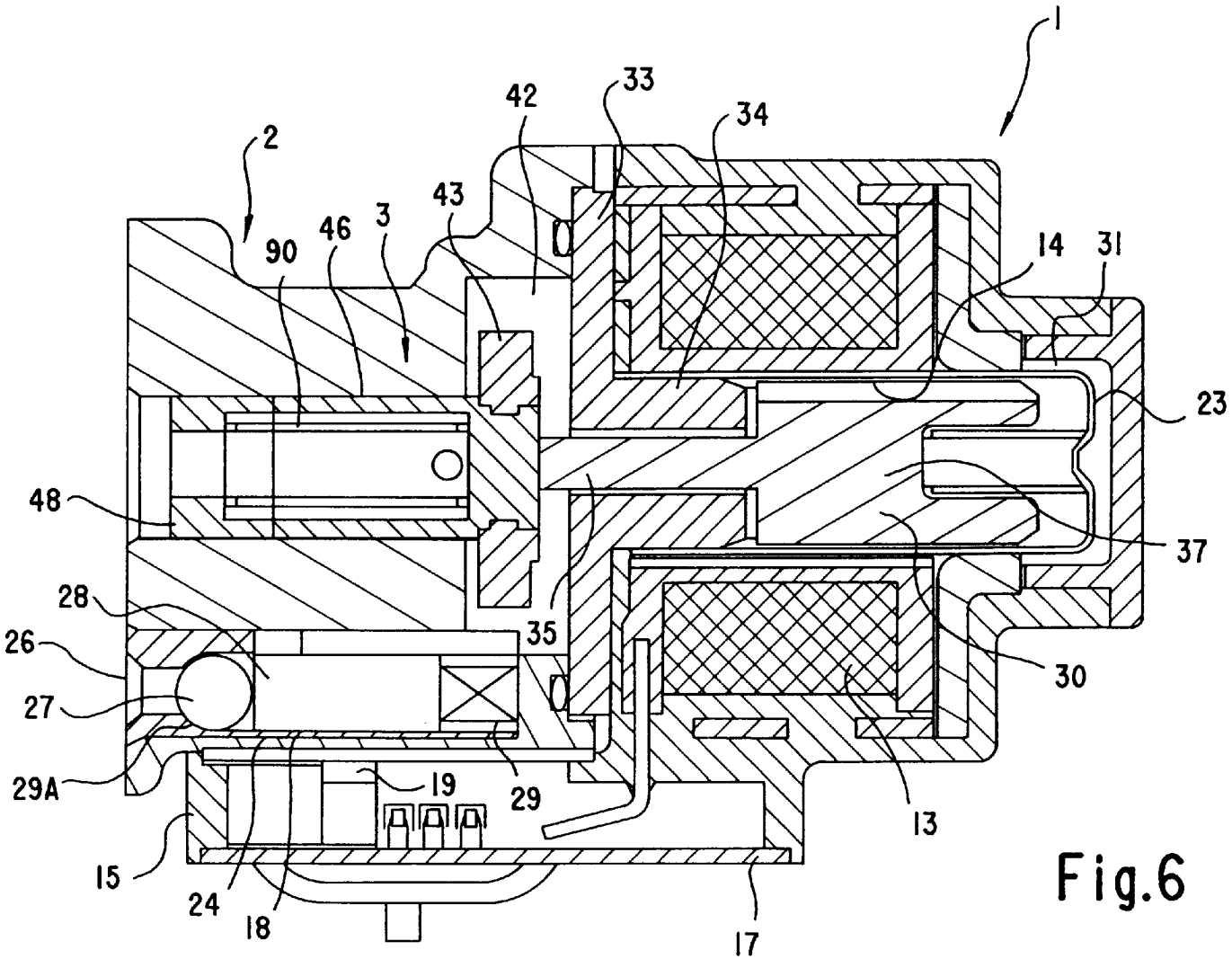
FIG. 6 is a longitudinal cross sectional view of the assembled pump.

A plug 48 is supported within the guide bore 47, the guide post 46 abutting the plug 48 when the pistons 44 reach the end of their pumping strokes. Conversely, the carrier 43 abuts the inner surface 73 of the pole piece 33 at the end of the return stroke of the pistons 44. The pole piece 33 therefore serves as the upper end stop for the carrier 43, and the plug 48 acts as a bottom end stop for the guide post 46 of the carrier 43. The position of the plug 48 within the guide bore 47 therefore sets the stroke of each piston 44 and therefore the pumping capacity of the pump. An elongate cavity 49 is provided within the guide post 46 to support a return spring 90 (as shown in FIG. 6). The plug 48 is also provided with a co-operating end cavity 50 for supporting an end of the return spring 90.

This arrangement enables rapid and accurate setting of the piston stroke during manufacture of the pump. As shown in FIG. 8, a production jig 80 can be used to set the piston stroke. The production jig 80 has a datum surface 81 and a stepped portion 82 extending from the datum surface 81, the stepped portion 82 providing a calibration surface 83. The spacing 85 between the plane of the datum surface 81 and the calibration surface 83 is the same as and sets the piston stroke.

During manufacture of the pump, the piston stroke is set by placing the jig 80 within the shallow cavity 40 of the second enclosure 20 such that the periphery of the datum surface 81 abuts the bottom surface 84 of the shallow cavity 40. The stepped portion 82 extends into the second enclosure cavity 42. With the carrier 43 and guide post 46 assembly respectively supported within the second enclosure cavity 42 and guide bore 47 and with the carrier 43 abutting the calibration surface 83, the plug 48 is press fitted into the guide bore 47 towards the opposing jig 80 until the plug contacts the guide post 46. Because of the spacing 85 between the datum and calibration surfaces 81, 83, of the jig 80, the piston stroke is correctly set by this method. In the assembled pump, the inner surface 33*a* of the pole piece 33 is in the same plane as the datum surface 81 of the jig 80. The method therefore provides a rapid and consistent way of accurately setting the piston stroke.

It is however also envisaged that the plug 48 be threaded to enable manual adjustment of the position thereof within a similarly threaded guide bore 47 and therefore adjustment of the stroke of the pistons 44. It is also envisaged that means be provided to automatically alter the position of the plug 48 to thereby allow automatic control of the pumping capacity. Other mechanical means to alter the piston stroke are also envisaged.

The extended leg 15 of the first enclosure 10 is substantially planar in shape. When the pump is assembled as shown in FIG. 6, the extended leg 15 can be positioned flat against or immediately adjacent the planar side surface 24 of the second enclosure 20. The extended leg 15 also does not extend beyond the second enclosure 20 and therefore does not add to the length of the assembled pump. The diagnostic arrangement within the pump is completed when the two sections 1, 2 of the pump are assembled together.

The armature sleeve 31 is received in the elongate bore 14 of the first enclosure 10 when the two sections 1, 2 are assemblied. This completes the electromagnetic circuit required to actuate the armature 30 supported within the armature sleeve 31.

This arrangement facilitates rapid assembly of the pump because the two sections can be easily coupled, the armature sleeve 31 being readily insertable into the elongate bore 14. This is advantageous for high volume automated assembly. It is also envisaged that the armature sleeve 31 and elongate bore 14 may be of a modified shape (i.e. male and female) to facilitate rapid assembly of the two sections 1, 2.

The Hall Effect sensor 19 supported within the extended leg 15 is positioned adjacent the planar side surface 24 so that the sensor 19 is isolated from but still in close physical proximity to the inlet relief valve 22 which is also positioned adjacent the planar side surface 24. The Hall Effect sensor 19 senses movement of the body element 28 within the valve cavity 25 when there is flow therethrough.

The Hall Effect sensor 19 senses the change of magnetic flux density along the elongate axis of the magnetic body element 28 as it is displaced within the valve cavity 25. In an enhancement of this system, the hall Effect sensor 19 can also sense the magnetic flux of the solenoid coil 13 during energisation thereof. This therefore provides two separate components of magnetic flux that can be sensed by the sensor 19.

The magnitude and direction of the magnetic flux of the solenoid coil 13 sensed by the sensor 19 is a function of the spatial proximity of the sensor 19 to the solenoid coil 13, the magnitude of the coil current and the number of coil turns thereof. To optimise the operation of this system, the polar direction of the magnetic flux from the coil 13 is arranged by polarity selection considerations of the current flow direction relative to the selected magnetic polarity of the body element 28 so that the components of increasing flux density from the solenoid coil 13 as the coil current is increased is additive with the increased flux density due to the displacement of the body element 5 resulting from fluid flow through the valve cavity 25. This results in an enhanced system which can be more reliable as it senses two separate components.

The sensor 19 only provides verification of movement above a predetermined threshold value. This is useful for oil pumps for internal combustion engines as air bubbles passing through the relief valve 22 will not satisfactorily displace the ball member 27 and therefore the body element 28 to the same extent as the oil flow. However, the sensor 19 can be set to ignore movement caused by small air bubbles but react to movement caused by large air bubbles. The Hall Effect sensor 19 provides a signal to a control system when movement above the threshold value is sensed. This control system is fully described in the applicant's co-pending patent application No. PM4767 and details of that system are incorporated herein by reference.

The control system can control the period of energisation of the solenoid assembly 11 and therefore the period of actuation of the pump. Furthermore, the control system can control the frequency of pump actuation dependent on the oil requirements of the engine.

The operation of the pumping mechanism 3 is best illustrated in FIG. 7*a* which shows the operation of the pumping mechanism 3 during a pumping stroke thereof, and FIG. 7*b* which shows the operation of the pumping mechanism 3 during a return stroke thereof.

The free end of the piston 44 includes a seal means 59 having a circumferential cavity 60 and a circumferentially extending seal member 61 supported within the cavity 60. The opposing sides of the cavity 60 are respectively defined by an inner shoulder 62 and an outer lip 63. The seal member 61 is moveable in a direction parallel to the elongate axis of the piston 44 between the inner shoulder 62 and the outer lip 63 during operation of the pump. The free end of the piston 44 including the seal means 59 is supported in and moves through a pump chamber 65. During the pumping stroke as shown in FIG. 7*a*, the seal member 61 moves to and abuts against the inner shoulder 62 preventing the flow of fluid back along the piston bore 45. The fluid is therefore pumped from the pump chamber 65 through the discharge check valve 21. At the same time, fluid is drawn into the piston bore 45 and cavity 42 (as shown in FIG. 4) through the inlet relief valve 22.

On the return stroke as shown in FIG. 7*b*, the seal member 61 moves to and rests against the outer lip 63. Notches and/or openings are provided through the outer lip 63 to allow the flow of fluid past the outer lip 63. This allows fluid to re-fill the pump chamber 65. The discharge check valve 21 prevents this fluid from being pumped out or leaking out of the pump chamber 65. The check valve 21 further prevents oil from being drawn back into the pump chamber 65 upon the return stroke of the piston 44. Still further, the check valve 21 prevents oil from being drawn from the pump, for example, by the engine vacuum which exists in some engines downstream of the oil lines which the pistons 44 are pumping oil into.

The seal means 59 therefore functions either as a seal or as a valve. It is however also envisaged that more conventional means, which separately achieve each function, be used.

At the start of the piston stroke, the seal member 61 must move-from the outer lip 63 to the inner shoulder 62 of the circumferential cavity 60 before pumping of fluid can occur. This movement is therefore a "lost motion" for the piston 44 as no pumping occurs during this movement. The degree of lost motion varies depending on the spacing between the outer lip 63 and inner shoulder 62. The fluid delivery of otherwise identical pistons 44 can therefore differ where each piston 44 has a circumferential cavity 60 of different width resulting in a different lost motion/piston stroke ratio for each piston 44.

As noted above, the piston stroke can be altered by moving the plug 48 or by some other mechanical means. Because the lost motion for each piston remains constant, a small change in the piston stroke can significantly alter the fluid delivery of the piston 44. Furthermore, the delivery ratio between adjacent pistons 44 can be varied by varying the piston stroke. The ratio of fluid delivery from the piston 44 of the pump is not therefore fixed and can be varied. This enables the pump to be adapted for a wide range of operating conditions, as well as allowing the pump to simultaneously pump different amounts of more than one fluid.

Referring to the operation of the pump in general, when the solenoid assembly 11 is energised, the armature 30 moves away from the closed end 32 of the armature sleeve 31. Because the armature extension 35 abuts the carrier engagement surface 70, the movement of the armature 30 is transmitted to the carrier 43 and to the pistons 44. The pistons 44 therefore move through their pumping stroke when the solenoid assembly is energised. During the return stroke of the pistons 44, the solenoid assembly 11 is de-energised and the carrier 43, pistons 44 and the armature 30 are returned to their initial positions by means of the return spring supported within the guide post 46. The biasing spring prevents the armature 30 from impacting against the armature sleeve closed end 32 whilst maintaining the abutting contact between the armature extension 35 and the carrier engagement surface 70.

Certain advantages arise in operating the pump so that the solenoid assembly 11 is energised to move the pistons 44 through their pumping stroke, and is de-energised to allow the pistons 44 to move back in their return stroke. The operation of the pump can be more flexibly adapted to allow for variations in factors such as changes in oil viscosity and battery voltage for example because the period of the pumping stroke can be readily varied by controlling the period of energisation of the solenoid assembly 11. By comparison, in a pump where a spring is used to urge pistons through their pumping stroke, the spring will need to be selected to provide the spring force required for worst case conditions thereby limiting the flexibility of the pump under other conditions.

Furthermore, the control system for the pump can be adapted to achieve the maximum possible pumping rates while minimising the periods of energisation of the solenoid assembly. Low quiescent times between pumping strokes can also be achieved. The pump can therefore be operated at or near optimum efficiency.

This pump operation also facilitates the use of feedback means such as the above described Hall Effect sensor for providing feedback signals to the control system driving the pump. These signals assist in the efficient operation of the pump by, for example, enabling the control system to determine the required period of energisation of the solenoid assembly.

The above description described a preferred practical arrangement of the pump. Other arrangements are also envisaged which fall within the scope of the preceding broad description. It is for example also envisaged that both the solenoid assembly 11 and the armature assembly 23 be supported within the first enclosure 10. Also, a "capacitance effect" sensor may be used in place of the Hall Effect sensor. Furthermore, a sensor could be provided adjacent one or more or all of the discharge check valves 21.

I claim:

1. A pump including a first enclosure defined by a first outer surface and a second enclosure defined by a second outer surface, a pumping mechanism and an electromotive unit operable to drive the pumping mechanism, and a diagnostic sensor for detecting flow within a flow path of the second enclosure, the electromotive unit including a solenoid assembly having a solenoid coil, and an armature assembly, the solenoid coil and diagnostic sensor being sealed within the first enclosure, the second enclosure including an elongated armature sleeve supportable within a central bore of the solenoid coil and an armature slidably supported within the armature sleeve, the armature assembly and the pump mechanism being accommodated within the second enclosure, the pumping mechanism moving with the armature when the solenoid assembly is energised, wherein said first outer surface is located exterior to the second outer surface and said second outer surface is located exterior to the first outer surface.

2. A pump according to claim 1 including a flow responsive member supported within the flow path, the flow responsive member being displaceable when there is flow through the flow path, the diagnostic sensor detecting displacement of said member.

3. A pump according to claim 2 wherein a flow control valve controls the flow through the flow path and the flow responsive member is supported adjacent to a valve member of the flow control valve and is movable therewith.

4. A pump according to claim 2 wherein a flow control valve controls the flow through the flow path, and the flow responsive member is the valve member for the flow control valve or is formed integrally with the valve member of the flow control valve.

5. A pump according to claim 2 wherein the flow responsive member is formed of a magnetic material, and the diagnostic sensor is a Hall Effect sensor for detecting changes in magnetic flow due to displacement of the flow responsive member.

6. A pump according to claim 5 wherein the Hall Effect sensor detects displacement of the flow responsive member above a predetermined threshold value.

7. A pump according to claim 5 wherein the flow responsive member is shaped such that the clearance between the flow responsive member and the flow path varies in the direction of movement thereof to vary the pressure gradient thereacross as the flow responsive member is displaced.

8. A pump according to claim 5 wherein the Hall Effect sensor is located proximal to the solenoid coil of the solenoid assembly to thereby also allow sensing of the changes in magnetic flux of the solenoid coil when energised in addition to the changes in magnetic flux due to displacement of the flow responsive member.

9. A pump according to claim 8 wherein the magnetic flux sensed by the hall Effect sensor is also a function of the magnitude of the coil current, and/or the number of windings of the solenoid coil.

10. A pump according to claim 8 wherein the polar direction of the solenoid coil is arranged relative to the magnetic polarity of the flow responsive member so that the magnetic flux of the solenoid coil is adapted to be additive with the magnetic flux of the flow responsive member.

11. A pump according to claim 3 wherein the flow control valve controls the inlet flow to the pump.

12. A pump according to claim 1 wherein the solenoid coil and diagnostic sensor are hermetically sealed with the first enclosure.

13. A pump according to claim 1 wherein the first enclosure is an overmould casing moulded around at least the solenoid coil.

14. A pump according to claim 1 wherein the diagnostic sensor is provided within an extended leg of the first enclosure, the leg being locatable against a wall of the second enclosure, the flow path being provided adjacent said leg.

15. A pump according to claim 1 wherein the pumping mechanism includes a carrier, and at least one piston supported on the carrier, wherein the or each piston is slidably accommodated within a respective piston bore in the second enclosure.

16. A pump according to claim 15 wherein seal means are provided at or adjacent a free end of the at least one piston, the seal means providing a seal during a pumping stroke of the piston and allowing fluid flow thereacross during an opposing return stroke of the piston.

17. A pump according to claim 15 wherein the piston moves through their pumping stroke upon energisation of the solenoid coil.

18. A pump according to claim 16 wherein the seal means includes a circumferential cavity adjacent a free end of said piston defined between an inner shoulder and an outer lip, a circumferentially extending seal member supported within the cavity and displaceable therein, wherein the seal member seals the piston bore when abutting the inner shoulder and allows fluid flow therethrough when abutting the outer lip.

19. A pump according to claim 18 wherein a distance between said inner shoulder and said outer lip is adjustable to change a width of the circumferential cavity to thereby vary the pumping stroke of the piston in dependence upon the width of the circumferential cavity.

20. A pump according to claim 16 including a plurality of pistons, each piston being adapted to pump different amounts of fluid at each pump actuation.

21. A pump according to claims 15 wherein the carrier includes guide means for guiding the movement of the carrier, the guide means including a guide post extending from the carrier and slidably supported within a guide bore within the second enclosure, a plug provided within the guide bore, and a biasing means provided between the guide post and the plug, wherein the plug provides an end stop for the carrier.

22. A pump according to claim 21 wherein the position of the plug within the guide bore is variable to vary the stroke of the or each piston.

23. A pump according to claim 1 wherein the armature assembly includes a displaceable armature, at least substantially locatable within a bore of the solenoid coil.

24. A pump according to claim 1 wherein he armature assembly is supported by the second enclosure.

25. A pump according to claim 23 wherein the displacement of the armature is transmitted directly to the carrier of the pump mechanism.

26. A pump according to claim 1 wherein the armature assembly further includes an elongate armature sleeve, the armature being slidably supported within the armature sleeve, a pole piece supporting the armature sleeve, and an armature biasing means provided between the armature and a closed end of the armature sleeve.

27. A pump according to claim 26 wherein the second enclosure includes a cavity having a bottom surface therein for accommodating the pole piece, the pole piece providing an opposing end stop for the carrier.

28. A pump according to claim 26 wherein the pole piece completes the magnetic circuit of the armature assembly.

29. A method for setting the piston stroke of a pump according to claim 27 including the steps of locating a production jig in the cavity of the second enclosure, the production jig including a datum surface and a stepped portion extending from the datum surface and providing a calibration surface, the datum surface abutting the bottom surface of the cavity with the stepped portion extending into the second enclosure and abutting the carrier, and press fitting the plug into the guide bore until the plug abuts the carrier guide post, wherein the spacing between the datum surface and the calibration surface is at least substantially identical to the piston stroke to be set.

30. A pump according to claim 1, wherein the first enclosure is integrally formed.

31. A pump according to claim 1, wherein the exterior of the first enclosure forms a cavity within which at least part of the second enclosure is fitted.

32. A pump comprising: a first enclosure; a second enclosure; a pumping mechanism; an electromotive unit including a solenoid assembly having a solenoid coil, and an armature assembly, the electromotive unit being operable to drive the pumping mechanism; and a diagnostic sensor for detecting flow within a flow path of the second enclosure, wherein the solenoid coil and the diagnostic sensor are sealed within the first enclosure; the second enclosure including an elongated armature sleeve supportable within a central bore of the solenoid coil and an armature slidably supported within the armature sleeve, the armature assembly and the pump mechanism being accommodated within the second enclosure, the first enclosure includes first and second portions in communication with each other, the first portion circumferentially surrounds a portion of the second enclosure and the second portion housing the diagnostic sensor is positioned asymmetrically with respect to an axis of symmetry of the armature.

33. The pump of claim 32, wherein an exterior of the first enclosure forms a cavity within which at least part of the second enclosure is fitted.

34. A pump comprising:

a first enclosure;

a second enclosure;

a pumping mechanism;

an electromotive unit including a solenoid assembly having a solenoid coil, and an armature assembly, the electromotive unit being operable to drive the pumping mechanism; and a diagnostic sensor for detecting flow within a flow path of the second enclosure, wherein the solenoid coil and the diagnositc sensor are sealed within the first enclosure;

the second enclosure including an elongated armature sleeve supportable within the armature sleeve, the armature assembly and the pump mechanism being accommodated within the second enclosure, the first enclosure surrounds a portion of the second enclosure and includes first and second portions in communication with each other, the second portion housing the diagnostic sensor and being positioned against a wall of the second enclosure adjacent to flow path of the second enclosure.

35. The pump of claim 34, wherein an exterior of the first enclosure forms a cavity within which at least part of the second enclosure is fitted.

* * * * *